US005174658A

United States Patent [19]

Cook et al.

[11] Patent Number: 5,174,658

[45] Date of Patent: Dec. 29, 1992

[54] SELF-EXPANDING AND RECLOSABLE FLEXIBLE POUCH

[75] Inventors: Charles D. Cook, Fairfield; Edward P. Hammond, Cincinnati, both of Ohio

[73] Assignee: The Procter & Gamble Company, Cincinnati, Ohio

[21] Appl. No.: 729,119

[22] Filed: Jul. 12, 1991

[51] Int. Cl.[5] ..... B65D 33/02; B65D 33/16

[52] U.S. Cl. ..... 383/33; 383/61; 383/63; 150/900

[58] Field of Search ..... 383/33, 34, 61, 63, 383/65; 150/900

[56] References Cited

U.S. PATENT DOCUMENTS

| | | | |
|---|---|---|---|
| 1,413,079 | 4/1922 | Waid . | |
| 1,798,945 | 3/1931 | Lamarthe . | |
| 2,080,402 | 5/1937 | Herman | 206/41 |
| 2,107,216 | 2/1938 | Rogers | 383/33 |
| 2,232,888 | 2/1941 | Schimelmitz . | |
| 2,519,290 | 8/1950 | Saltz | 383/61 |
| 2,674,289 | 4/1954 | Silverman | 383/61 |
| 3,272,248 | 9/1966 | O'Farrell . | |
| 3,310,224 | 3/1967 | Laguerre . | |
| 3,380,646 | 4/1968 | Doyen et al. . | |
| 3,426,814 | 2/1969 | Bundy | 383/63 |
| 3,463,381 | 8/1969 | Wainberg . | |
| 3,618,850 | 11/1971 | Palmer . | |
| 3,635,376 | 1/1972 | Hellstrom | 222/107 |
| 3,790,744 | 2/1974 | Bowen | 219/121 LM |
| 3,893,649 | 7/1975 | Cornell et al. | 383/33 |
| 3,909,582 | 9/1975 | Bowen | 219/121 LM |
| 4,290,467 | 9/1981 | Schmidt . | |
| 4,317,478 | 3/1982 | Babbidge . | |
| 4,451,246 | 5/1984 | Herrera-Gutierrez | 493/215 |
| 4,593,408 | 6/1986 | Drobish et al. | 383/43 |
| 4,617,683 | 10/1986 | Christoff | 383/63 |
| 4,618,383 | 10/1986 | Herrington | 156/66 |
| 4,655,862 | 4/1987 | Christoff et al. | 156/66 |
| 4,691,372 | 9/1987 | Van Erden | 383/63 |
| 4,709,533 | 12/1987 | Ausnit | 53/451 |
| 4,898,477 | 2/1990 | Cox et al. | 383/33 |
| 4,909,017 | 3/1990 | McMahon et al. | 53/410 |
| 4,925,316 | 5/1990 | Van Erden et al. | 383/61 |
| 4,954,124 | 9/1990 | Erickson et al. | 493/195 |
| 4,986,673 | 1/1991 | Bell | 383/61 |

FOREIGN PATENT DOCUMENTS

| | | |
|---|---|---|
| 345930 | 12/1989 | European Pat. Off. . |
| 0442299A1 | 8/1991 | European Pat. Off. . |
| 17656 | 9/1898 | Fed. Rep. of Germany . |
| 0308754 | 12/1989 | Japan . |
| WO91/18797 | 12/1991 | World Int. Prop. O. . |

*Primary Examiner*—Stephen P. Garbe

*Attorney, Agent, or Firm*—E. Kelly Linman; Michael E. Hilton; Kevin C. Johnson

[57] ABSTRACT

A sealed, self-expanding, reclosable, flexible pouch having a pair of extensible stays located in the throat area of the pouch. The extensible stays are biased toward a circular configuration but are initially held substantially flat in a stressed condition by the pouch's sealed top portion. When the pouch's top portion is removed, the extensible stays expand to their relaxed expanded configuration and thereby expand and open the throat area of the pouch. An inwardly oriented male securement means is attached to one extensible stay and extends along the throat area of the pouch. A complementary inwardly oriented female securement means is attached to the other of the opposing extensible stays and extends along the throat area of pouch. The complementary male and female securement means permits the throat area of the pouch to be sufficiently closed after initial opening, thereby constraining the pouch's contents.

16 Claims, 2 Drawing Sheets

SELF-EXPANDING AND RECLOSABLE FLEXIBLE POUCH

FIELD OF THE INVENTION

The present invention relates to flexible packaging pouches, and more particularly relates to flexible pouches that expand after opening and are reclosable.

BACKGROUND INFORMATION

Numerous products today are shipped and sold in reclosable plastic bags. Examples of plastic bags having a reclose feature can be found in U.S. Pat. No. 4,617,683 issued to Christoff on Oct. 14, 1986, and U.S. Pat. No. 4,986,673 issued to Bell on Jan. 22, 1991. When using one of the bags disclosed in the above U.S. patents, the consumer first removes the sealed portion of the bag located directly above the reclosing feature. The consumer then pulls apart or separates the male and female securement members of the reclose feature. The consumer can now remove the desired portion of the product from the bag. The consumer then manually engages the male and female securement members of the reclose feature, thereby temporarily securing the bag and its contents until the next use. However, as is often the case with a bag having a reclose feature, there is no biasing means to keep the bag mouth open after the reclose feature has been pulled apart by the consumer. The lack of a biasing means to keep the package in a fully open condition can be cumbersome and annoying to a consumer who desires to have the bag mouth remain open after the reclose feature has been pulled apart, thereby facilitating access to the product within the bag. Improved access to the product is particularly desirable when the bag contains certain products, many of which are not entirely consumed upon initial opening of the pouch, e.g., coffee, salted snacks, fabric softeners, cleaning products, detergents, pharmaceuticals, etc. Improved access is also highly desirable when the pouch is to be used as a vessel for the reconstituting fluid, e.g., concentrated beverages which are to be diluted with water.

Commonly assigned U.S. Pat. No. 4,898,477 issued to Cox et al. on Feb. 6, 1990 and which is hereby incorporated herein by reference discloses a self-expanding flexible pouch that can be used as a measuring device for reconstituting a concentrated product contained therein. The flexible pouch includes an extensible stay located in the throat area of the pouch. When the pouch's top portion is removed, the extensible stay expands to a circular configuration opening the pouch's throat area. The consumer can then "milk" the concentrated product out of the pouch. The opening of the pouch's throat area allows the consumer then to reconstitute the fluid by adding water to the pouch and then pouring and mixing with the concentrated substance previously "milked" from the pouch. The Cox et al. pouch has the advantage of self-expansion, thereby improving access to the product within the pouch. However, this pouch would not be particularly well suited to package a product that required the pouch to be sealed between repeated multiple openings.

When using certain products that require repeated or intermittent use prior to exhaustion of the pouch's contents or when using products which are to be diluted using the empty pouch as a vessel for the reconstituting fluid, the consumer not only desires that the bag be reclosable between uses, but also that the bag mouth remain open. By way of example, liquid fabric softener, granular detergents, and salted snacks are products that the consumer would like to reclose between uses to prevent spilling or preserve freshness, and would also prefer to have a self-opening feature to improve or facilitate product access.

Accordingly, it is an object of the present invention to provide a flexible pouch having a self-opening and reclosing device suitable for use with a wide assortment of products;

It is further an object of the present invention to provide a flexible pouch that will assume a substantially predetermined configuration upon opening;

It is further an object of the present invention to provide a flexible pouch that will collapse when discarded and thereby reduce the volume of generated waste material;

It is further an object of the present invention to provide a flexible pouch that is sufficiently rigid and stable when opened to allow a consumer to firmly grasp and pour a fluid from the pouch with confidence that the pouch will not collapse;

It is further an object of the present invention to provide, in a particularly preferred embodiment, a flexible pouch that can be readily opened without having to use an implement such as a pair of scissors or a knife;

It is still another object of the present invention to provide a flexible pouch that accomplishes the aforementioned objectives at minimal cost.

SUMMARY OF THE INVENTION

Self-expandable and reclosable pouches of the present invention are particularly useful in packaging a wide variety of products. In a preferred embodiment of the present invention a sealed, self-expanding, reclosable, flexible pouch has a top portion and a throat area subjacent to the top portion. The flexible pouch includes front and back sidewall panels superimposed over one another and sealed together along their top, side, and bottom peripheral edges. The front and back sidewall panels have an inner surface. A pair of extensible stays each being associated with one of the inner surfaces of the front and back sidewall panels are located in the throat area of the pouch. The extensible stays have a relaxed, expanded configuration and a stressed collapsed configuration. The stays are initially held in a stressed, collapsed configuration by the sealed top portion of the pouch, whereby the stays expand to their relaxed, expanded configuration when the top portion of the pouch is removed, thereby expanding the throat area of the pouch to provide ready access to its contents. An inwardly oriented male securement means is attached to one extensible stay and extends along the throat area of the pouch. A complementary inwardly oriented female securement means is attached to the other of the opposing extensible stays and extends along the throat area of the pouch. The inwardly oriented complementary male and female securement means permit sufficient engagement of the throat area of the pouch after initial opening by manually engaging the inwardly oriented complementary male and female securement means with one another.

In a particularly preferred embodiment of the present invention, the bottom portion of the pouch is provided with a bottom gusset panel whose peripheral edges are attached to the inner surface of the sidewall panels. The gusset panel's mid-section is preferably folded into a pleated arrangement and extends freely up into the interior of the pouch.

In a particularly preferred embodiment of the present invention, at least one line of weakness is provided in the front and back sidewall panels below the top peripheral seal and above the stays to facilitate easy opening without an opening utensil.

In use, a consumer grasps the pouch and removes the pouch's top portion by tearing the pouch along the line of weakness. After the pouch's top portion has been removed the extensible stay self-expands to its relaxed, expanded configuration, thereby spreading the pouch's throat area into a generally tubular configuration, provided the male and female securement means have not been engaged prior to initial opening. If the male and female securement means have been engaged, the consumer will then manually separate them allowing the extensible stay to self-expand. The resulting, generally tubular configuration of the pouch's throat area facilitates access to the product within the flexible pouch for consumer convenience. The consumer may then manually engage the male and female securement means with one another, thereby sealing the flexible pouch until access to the product is again desired. To open the flexible pouch the consumer grasps the pouch and manually separates the male and female securement means from one another, again allowing the extensible stay to self-expand.

BRIEF DESCRIPTION OF THE DRAWINGS

While the specification concludes with claims which particularly point out and distinctly claim the invention, it is believed that the present invention will be better understood from the following description of preferred embodiments, taken in conjunction with the accompanying drawings, in which like reference numerals identify identical elements and wherein:

DESCRIPTION OF THE PREFERRED EMBODIMENT

It should be noted that the following detailed description and illustration are directed to flexible pouches that are self-expanding and reclosable for containing such products as dry or powdered beverages, liquid or frozen single-strength beverages, concentrated juices, dry soups, baking mixes, cooking oils, salted snacks, dry and instant cereals, and other food products; medications, cold remedies, mouthwash, baking mixes, laundry soaps and softeners, adhesives, paints and hard surface cleaners.

Figure 1:
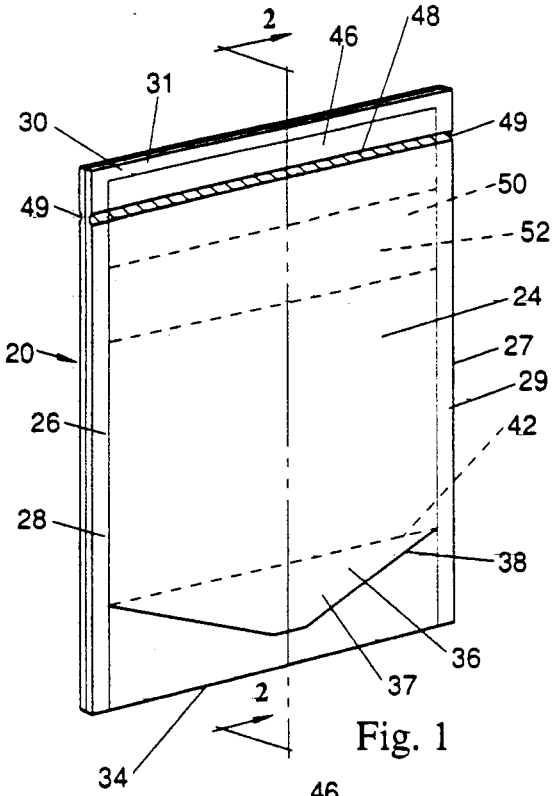
FIG. 1 is a schematic perspective view of a flexible pouch of the present invention shown with some of the pouch's internal features illustrated in phantom.
Figure 2:
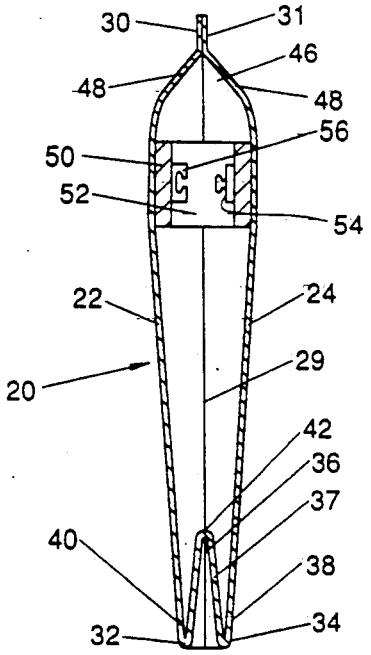
FIG. 2 is a schematic cross-sectional side view of the flexible pouch illustrated in FIG. 1 taken along section line 2—2.

With reference to the drawings wherein the same numeral is used to indicate common components, FIGS. 1 and 2 illustrate a self-expanding, reclosable, flexible pouch of the present invention generally indicated as 20. The pouch 20 is similar to the pouch disclosed in FIGS. 1 through 5B of the commonly assigned U.S. Pat. No. 4,898,477 issued to Cox et al. on Feb. 6, 1990 which is hereby incorporated herein by reference. Pouch 20 includes flexible sidewall panels 22 and 24 which are superimposed over one another and sealed together, e.g., heat-sealed, along side peripheral edges 26 and 27 to form side seals 28 and 29 respectively, and along top peripheral edge 30 to form top seal 31. Bottom peripheral edges 32 and 34 of sidewall panels 22 and 24, respectively, can also be sealed to one another to form a bottom seal and thereby complete a closed pouch structure. However, in a particularly preferred embodiment of the present invention illustrated in FIGS. 1 and 2, bottom gusset panel 36 (shown in phantom in FIG. 1) is attached to the inner surface of sidewalls 22 and 24 in bottom portion 37 of pouch 20 along generally arcuate seal lines 38 and 40, respectively, and preferably also in the area therebelow. The portion of bottom gusset panel 36 above seal lines 38 and 40 is not attached to the inner surface of sidewalls 22 and 24 such that midsection 42 of gusset 36 is free and extends up into the interior of pouch 20 in a pleated fashion as best seen in FIG. 2. Alternatively, gusset 36 and sidewalls 22 and 24 can be made from the same web of material. Gusset 36 can be formed by folding the bottom portion of the continuous web in a "W" section as disclosed in U.S. Pat. No. 3,380,646 issued to Doyen et al. on Apr. 30, 1968 and which is hereby incorporated herein by reference.

Top portion 46 of pouch 20 is preferably provided with a line of weakness 48 that extends laterally across both sidewalls 22 and 24 in close proximity to but below top peripheral seal 31 and above the extensible stay 50, described below. Line of weakness 48 may be formed by, for example, perforating or scoring sidewalls 22 and 24 with a laser or knife either individually before sidewalls 22 and 24 are sealed together, or collectively after they have been sealed together. One or both ends of line of weakness 48 preferably terminate with a notch 49, which provides a stress concentration and aids in starting a tear along line of weakness 48 when pouch 20 is opened by a consumer.

In a particularly preferred embodiment of the present invention, line of weakness 48 is partially formed in various selected layers of a barrier laminate structure, described below, from which sidewall panels 22 and 24 are made. This selective weakening of various layers, preferably the outer layers, of sidewall panels 22 and 24 may be accomplished by various means well known in the art. For example, using a beam of radiant energy emitted from a laser, such as that generally described in U.S. Pat. Nos. 3,790,744 and 3,909,582, both of said patents being hereby incorporated herein by reference. It has been found that if the line of weakness 48 is formed individually in sidewalls 22 and 24 while they are in the form of continuous running webs prior to sealing, then very strict web control should be used to ensure that the line of weakness cut in one web aligns with the other line of weakness cut in the other web when the webs are superimposed. Alternatively, it has been found that much less stringent web control can be used if two or more lines of weakness spaced approximately 0.016 inches (0.4 mm) from one another are scored in each sidewall to ensure that one weakness line in one sidewall will substantially align with one of the lines of weakness scored in the other sidewall when the webs are superimposed.

Figure 3:
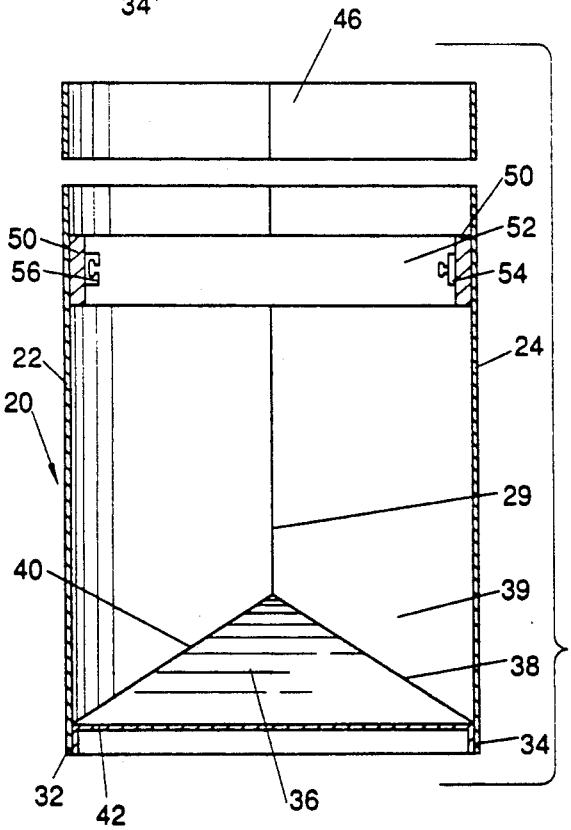
FIG. 3 is a schematic cross-sectional side view of the flexible pouch illustrated in FIG. 1 taken at a point corresponding to section line 2—2, except that the pouch is shown with its top section removed and in its expanded configuration.

Still referring to FIGS. 1, 2, and 3, extensible stay 50 (shown in phantom in FIG. 1) is located in throat area 52 of pouch 20 and attached to the inner surface of sidewalls 22 and 24 by using, for example, an adhesive. Stay 50 is preferably made of a relatively stiff, resilient material having a memory, such as a nylon or high density polyethylene. The term "memory" is intended to mean the phenomenon where a material returns to its original, unstressed configuration after having been deformed to a stressed configuration and the deforming force causing the deformation has been removed.

Integrally attached to the inner surface of extensible stay 50 are male and female securement means 54 and 56, respectively, best seen in FIG. 2. Male and female securement means 54 and 56 extend along the entire length of the throat area 52. Male and female securement means 54 and 56 are preferably made of a flexible material having a lower modulus than that of the material used to make extensible stay 50. When extensible stay 50 is secured inside sealed pouch 20 as shown in FIGS. 1 and 2, top seal 31, sidewalls 22 and 24, and the upper portions of side seals 28 and 29 cooperate in holding extensible stay 50 in its collapsed, stressed configuration.

Figure 4:
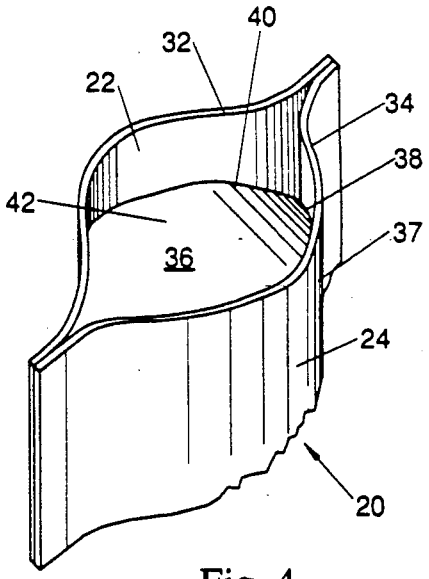
FIG. 4 is an enlarged partial schematic perspective view of the bottom gusset portion of a flexible pouch of the present invention shown in its expanded configuration.

Pouch 20 assumes a generally flat configuration after it has been formed, filled, and sealed as shown in FIGS. 1 and 2. However, if pouch 20 has been filled with a product such as a liquid detergent, pouch 20 will assume a more tubular configuration as gusset panel 36 expands, as seen in FIG. 4. In use, a consumer grasps pouch 20 and removes top portion 46 by tearing sidewalls 22 and 24 along line of weakness 48. After top portion 46 has been removed from pouch 20 as shown in FIG. 3, extensible stay 50 expands outwardly to its unstressed configuration, which is preferably circular or elliptical in shape. However, if prior to initial opening male and female securement means 54 and 56 have been engaged with one another, the consumer then grasps the upper portion of opposing sidewalls 22 and 24 pulling them apart, thereby separating male and female securement means 54 and 56 and allowing extensible stay 50 to self-expand. This self-expanding action of extensible stay 50 causes throat area 52 of pouch 20 to open up and expand into a generally tubular configuration without the consumer having to insert his fingers or a utensil into throat area 52 to pry sidewalls 22 and 24 apart.

If the flexible pouch 20 contains a product that the consumer will use intermittently, the consumer will then want to manually engage the male and female securement means 54 and 56 located on opposing extensible stays 50. The consumer engages male and female securement means 54 and 56 with one another by manually pressing the exterior surfaces of pouch sidewalls 22 and 24 together. By engaging male and female securement means 54 and 56 with one another the consumer can be confident that the product within pouch 20 is secure as pouch 20 is substantially completely reclosed.

To open the pouch after male and female securement means 54 and 56 have been engaged, the consumer simply grasps the upper portion of opposing sidewall panels 22 and 24 and manually separates the male securement means 54 from the female securement means 56. Extensible stay 50 then self-expands to its unstressed configuration which is preferably circular or elliptical in shape providing sufficient access to the product within pouch 20. The steps of opening and closing pouch 20 are repeated by the consumer until the product has been completely dispensed.

Self-expanding flexible pouches of the present invention are also particularly useful in containing concentrated products, i.e., products which require a reconstituting fluid to be added. If the pouch contains a concentrated product, the consumer pours or "milks out" the concentrated product contained within pouch 20 into a large container and then uses pouch 20 to accurately measure the amount of fluid that needs to be added to the large container for proper reconstitution. When a fluid is placed inside pouch 20, bottom gusset panel 36 unfolds and drops downward such that midsection 42 assumes a generally planar configuration, as shown in FIGS. 3 and 4. Simultaneously, the fluid within pouch 20 further expands throat area 52, and also expands the lower portion of flexible sidewalls 22 and 24 such that, combined with the unfolding and expanding action of bottom gusset 36, bottom portion 38 of pouch 20 expands into a generally tubular configuration. When so expanded, pouch 20 exhibits a predetermined, generally tubular configuration with a predictable and repeatable internal volume such that it can be conveniently used as the means for accurately measuring the amount of fluid necessary for properly reconstituting the concentrated product. In addition, spread-apart bottom peripheral edges 32 and 34 of sidewalls 22 and 24, respectively, cooperate to provide a stable base upon which pouch 20 is able to stand on its own on a flat surface.

Sidewalls 22 and 24, and gusset 36 can be made from a wide variety of materials that meet certain preferred specifications. For example, they must be sufficiently thick and tough enough to resist punctures and leaks. In addition, sidewalls 22 and 24, and gusset 36 are preferably selected from materials that can be easily handled, formed, and sealed together, preferably by heat-sealing. For certain products, e.g., foods in general, sidewalls 22 and 24, and bottom gusset 36 are preferably made of a material or combination of materials that have certain characteristics such as compatibility with the food in question, absorption resistance, resistance to heat and cold, and resistance to light, air, and moisture. Laminate materials having the above mentioned and other important characteristics are generally described in commonly assigned U.S. Pat. No. 4,898,477 issued to Cox et al. on Feb. 6, 1990 which is hereby incorporated by reference herein.

Figure 5:
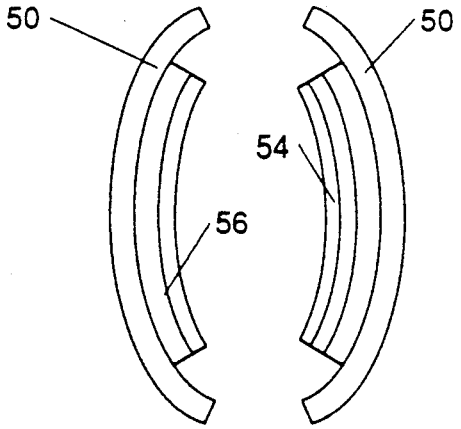
FIG. 5 is an enlarged schematic perspective view of a particularly preferred embodiment of an extensible stay and reclosure device that may be used in pouch's throat area.
Figure 6:
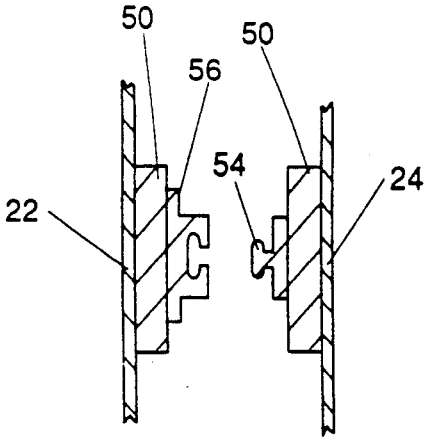
FIG. 6 is an enlarged partial cross-sectional view displaying the male and female securement means adhered to the extensible stays in the pouch's throat area.

Referring now to FIGS. 5 and 6, opposing male and female securement means 54 and 56 are shown attached to opposing extensible stays 50. Extensible stays 50 and male and female securement means 54, 56 can be made separately from one another by extruding them from low density polyethylene or high density polyethylene.

In one particular embodiment the male and female securement means 54 and 56 are elongated by longitudinal stretching and attached to opposing extensible stays 50 while in an elongated condition. The securement means 54 and 56 can then be attached to stays 50 by using, for example, a heat seal or an adhesive. After the male and female securement means 54 and 56 have been attached to opposing extensible stays 50 they return, at least to a degree, to their relaxed pre-stretched condition, thereby creating the self-opening feature of opposing extensible stays 50. Opposing extensible stays 50 with male and female securement means 54 and 56 attached thereto, are attached as a unit to the inner surface of pouch sidewalls 22 and 24, by using, for example, an adhesive.

Figure 7:
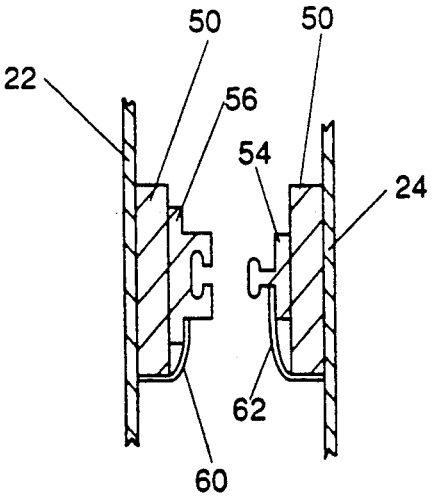
FIG. 7 is an enlarged partial schematic cross-sectional view of another particularly preferred embodiment of an extensible stay and reclosure device that may be used in pouches of the present invention.

FIG. 7 illustrates another embodiment disclosing an alternative method for creating the self-opening feature of extensible stay 50 and male and female securement means 54 and 56. As disclosed above, extensible stays 50 and male and female securement means 54, 56 can each be made separately from one another by extruding them from low density polyethylene or high density polyethylene. Male and female securement means 54 and 56 are then attached to opposing extensible stays 50. Opposing extensible stays 50 along with male and female securement means 54 and 56 attached thereto, are then attached as a unit to the inner surface of pouch sidewalls 22 and 24. A layer of heat shrinkable film 60 and 62 is attached to male and female securement means 54 and 56, respectively, below their respective engaging portions, such that the heat shrinkable film 60 and 62 will not interfere with the engagement portions of male and female securement means 54 and 56. The heat shrinkable film 60 and 62 is also attached to extensible stays 50. After the remainder of the bag is formed and sealed, hot air is blown into the top portion of pouch 20, thereby shrinking heat shrinkable films 60 and 62, providing the curvature necessary to create the opening feature of extensible stays 50 in pouch's throat area 52.

In still another embodiment (not shown), extensible stays 50 and male and female securement means 54, 56 can be made separately from one another by extruding them from low density polyethylene or high density polyethylene. Each extensible stay 50 is then hot rolled or cold rolled creating a curvature. This curvature provides the self-opening feature for extensible stay 50. Male and female securement means 54 and 56 are then attached to opposing extensible stays 50. Opposing extensible stays 50 along with male and female securement means 54 and 56 are then subsequently attached as a unit to the inner surface of pouch sidewalls 22 and 24, respectively.

Figure 8:
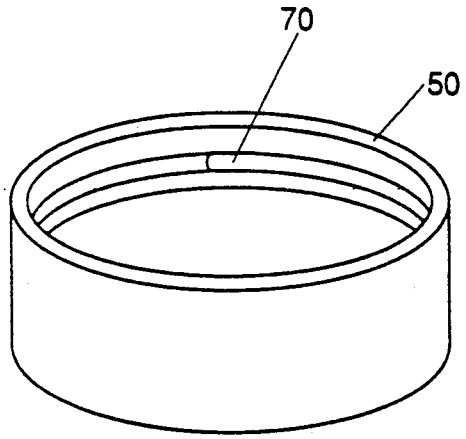
FIG. 8 is an enlarged schematic perspective view of another particularly preferred embodiment of an extensible stay and reclosure device that may be used in pouches of the present invention.

FIG. 8 illustrates yet another embodiment of extensible stay 50. Extensible stay 50 is of a one-piece, continuous construction. Extensible stay 50 is preferably provided with a securement means 70 on its interior surface. Securement means 70 is a commercially available product manufactured by 3M under the name "Scotchpak" brand reclosable system YR-8490. Securement means 70 is attached to the inner surface of extensible stay 50 in a butt relation. Extensible stay 50 and securement means 70 are then attached as a unit to the inner surface of sidewall panels 22 and 24. The one-piece, continuous construction provides the opening feature for extensible stay 50 as it is biased toward its relaxed circular configuration.

Although particular embodiments of the present invention have been shown and described, modifications may be made to the flexible pouch without departing from the teachings of the present invention. The terms used in describing the invention are used in their descriptive sense and not as terms of limitation, it being intended that all equivalents thereof be included within the scope of the appended claims.

What is claimed is:

1. A sealed, self-expanding, reclosable, flexible pouch for containing a product, said pouch having a top portion, a throat area subjacent said top portion, and a bottom portion, said pouch comprising:

a) front and back sidewall panels superimposed over one another and sealed together along their top and side peripheral edges, said front and back sidewall panels also being secured in sealed relation to said bottom portion of said pouch to prevent product within said pouch from escaping from said pouch prior to opening thereof, each of said front and back panels having an inner surface;

b) a pair of extensible stays each being associated with one of said inner surfaces of said front and back sidewall panels and located in said throat area of said pouch, said extensible stays having a relaxed, expanded configuration and a stressed collapsed configuration, said stays initially being held in said stressed, collapsed configuration by said sealed top portion of said pouch, whereby said stays expand to said relaxed, expanded configuration when said top portion of said pouch is removed, thereby expanding said throat area of said pouch;

c) an inwardly oriented male securement means attached to one extensible stay, said male securement means having a length extending along said throat area of said pouch and a complementary inwardly oriented female securement means attached to the other of said opposing extensible stays, said female securement means having a length extending along said throat area of said pouch, thereby permitting substantially complete reclosure of said pouch after initial opening by engagement of said complementary male and female securement means with one another along substantially their entire lengths; and d) a heat shrinkable film being attached to said extensible stays and said male and female securement means, said heat shrinkable film being exposed to heat thereby shrinking said heat shrinkable film.

2. The self-expanding, reclosable, flexible pouch according to claim 1 further comprising at least one line of weakness in said front and said back sidewall panels located below said top peripheral seal and above said stays.

3. The self-expanding, reclosable, flexible pouch according to claim 2 wherein said front and back sidewall panels are made from a laminate comprised of layers of barrier films and wherein said at least one line of weakness does not extend through the innermost layer of barrier film.

4. The self-expanding, reclosable, flexible pouch according to claim 3 wherein said layers of barrier films are selected from the group consisting of polyesters, polyethylenes, polypropylenes, ethylene vinyl alcohol, and mixtures, copolymers, and coextrusions thereof.

5. The self-expanding, reclosable, flexible pouch according to claim 1 further comprising a bottom gusset panel attached to said inner surface of said front and back sidewall panels along said bottom peripheral edges of said pouch, said gusset panel initially being folded up into said pouch in a pleated arrangement, said gusset panel unfolding and expanding when a fluid is poured into said pouch, thereby expanding said bottom portion of said pouch into a substantially tubular configuration.

6. The self-expanding, reclosable, flexible pouch according to claim 1 wherein the male and female securement means are elongated by longitudinal stretching and attached to said extensible stays while in an elongated condition.

7. The self-expanding, reclosable, flexible pouch according to claim 1 wherein said extensible stays are hot rolled prior to being laminated to said pouch.

8. The self-expanding, reclosable, flexible pouch according to claim 1 wherein said extensible stays are cold rolled prior to being laminated to said pouch.

9. A sealed, self-expanding, reclosable, flexible pouch having a top portion, a throat area subjacent said top portion, and a bottom portion, said pouch comprising:

a) front and back sidewall panels superimposed over one another and sealed together along their top and side peripheral edges, said panels having an inner surface;

b) a pair of extensible stays each being associated with one of said inner surfaces of said front and back sidewall panels and located in said throat area of said pouch, said extensible stays having a relaxed, expanded configuration and a stressed collapsed configuration, said stays initially being held in said stressed, collapsed configuration by said sealed top portion of said pouch, whereby said stays expand to said relaxed, expanded configuration when said top portion of said pouch is removed, thereby expanding said throat area of said pouch;

c) an inwardly oriented male securement means attached to one extensible stay, said male securement means having a length extending along said throat area of said pouch and a complementary inwardly oriented female securement means attached to the other of said opposing extensible stays, said female securement means having a length extending along said throat area of said pouch, thereby permitting substantially complete reclosure of said pouch after initial opening by engagement of said complementary male and female securement means with one another along substantially their entire lengths;

d) a bottom gusset panel attached to said inner surface of said front and back sidewall panels in said bottom portion of said pouch; and e) a heat shrinkable film attached to said extensible stays and said male and female securement means, said heat shrinkable film being exposed to heat thereby shrinking said heat shrinkable film.

10. The self-expanding, reclosable, flexible pouch according to claim 9 further comprising at least one line of weakness in said front and said back sidewall panels located below said top peripheral seal and above said stays.

11. The self-expanding, reclosable, flexible pouch according to claim 10 wherein said front and back sidewall panels are made from a laminate comprised of layers of barrier films and wherein said at least one line of weakness does not extend through the innermost layer of barrier film.

12. The self-expanding, reclosable, flexible pouch according to claim 9 wherein said bottom gusset panel is made from a laminate comprised of layers of barrier films.

13. The self-expanding, reclosable, flexible pouch according to claim 9 wherein said gusset panel is initially folded up into said pouch in a pleated arrangement, said gusset panel unfolding and expanding when a fluid is poured into said pouch, thereby expanding said bottom portion of said pouch into a substantially tubular configuration.

14. The self-expanding, reclosable, flexible pouch according to claim 9 wherein the male and female securement means are elongated by longitudinal stretching and attached to said extensible stays while in an elongated condition.

15. The self-expanding, reclosable, flexible pouch according to claim 9 wherein said extensible stays are hot rolled prior to being laminated to said pouch.

16. The self-expanding, reclosable, flexible pouch according to claim 9 wherein said extensible stays are cold rolled prior to being laminated to said pouch.

* * * * *